US007334685B2

(12) United States Patent
Mathiez

(10) Patent No.: US 7,334,685 B2
(45) Date of Patent: Feb. 26, 2008

(54) PACKAGING AND COVER FOR PACKAGING FOR COSMETIC OR PHARMACEUTICAL COMPOSITIONS

(75) Inventor: Jean-Louis Mathiez, Limours (FR)

(73) Assignee: Coty Inc., New York, NY (US)

( * ) Notice: Subject to any disclaimer, the term of this patent is extended or adjusted under 35 U.S.C. 154(b) by 208 days.

(21) Appl. No.: 09/865,056

(22) Filed: May 24, 2001

(65) Prior Publication Data

US 2002/0014434 A1 Feb. 7, 2002

(30) Foreign Application Priority Data

Nov. 24, 1998 (FR) ..... 98 14759
Nov. 22, 1919 (WO) ..... PCT/IB99/01867

(51) Int. Cl.
*B65D 69/00* (2006.01)

(52) U.S. Cl. ..... 206/581; 132/293

(58) Field of Classification Search ..... 132/293, 132/294, 299, 307; 206/581; 220/720, 721
See application file for complete search history.

(56) References Cited

U.S. PATENT DOCUMENTS 1,911,691 A * 5/1933 Jacobson ..... 132/299
2,043,726 A * 6/1936 Bangs ..... 132/306
3,117,691 A 1/1964 Williams ..... 220/60
4,906,118 A * 3/1990 Crooks ..... 401/6
5,865,194 A * 2/1999 Gueret ..... 132/299
5,875,918 A * 3/1999 Sheffler et al. ..... 220/783
5,896,866 A * 4/1999 Quennessen ..... 132/293

FOREIGN PATENT DOCUMENTS

EP 0551557 A 4/1992
EP 0574107 A1 12/1993
EP 0839471 A1 5/1998
EP 0845230 A1 6/1998
EP 0861613 A2 9/1998
WO 98/36985 2/1997

OTHER PUBLICATIONS

Kizawa, I., "Hermetic cosmetic container", *Patent Abstracts of Japan*, vol. 1997, No. 06, appln No. 07196752., (Jun. 30, 1997).
Yamane, K., "Compact", *Patent Abstracts of Japan*, vol. 1997, No. 02, JP 08 256828 A, (Feb. 28, 1997).
Yuri, H., "Refill Container", *Patent Abstracts of Japan*, vol. 1996, No. 06, JP 08 052027 A, (Jun. 28, 1996).

* cited by examiner

*Primary Examiner*—David T. Fidei
(74) *Attorney, Agent, or Firm*—Schwegman, Lundberg & Woessner, P.A.; Janal M. Kalis

(57) ABSTRACT

One embodiment of the present invention includes a cover (6) for a packaging for a cosmetic and/or a pharmaceutical composition. The cover (6) comprises means of attachment on a container of the packaging and a sealing wall for sealing an opening of the container (3). The sealing wall is a flexible wall that is elastically deformable by a difference in pressure exerted on its two main sides.

24 Claims, 12 Drawing Sheets

PACKAGING AND COVER FOR PACKAGING FOR COSMETIC OR PHARMACEUTICAL COMPOSITIONS

BACKGROUND OF THE INVENTION

The present invention relates to a cover for packaging of cosmetic compositions and/or pharmaceutical compositions, to a packaging such as refillable packaging and sealed packaging for cosmetic and/or pharmaceutical compositions, and to cosmetic and/or pharmaceutical compositions packaged in the packaging.

Packagings for cosmetic compositions are typically provided with a rigid cover which prevents variation of the internal volume of the packaging. In the case of sealed packaging, a variation of the internal pressure, for example, an increase of the internal pressure induced by closing of the cover, or a variation of the external pressure, induces a difference of pressure between the interior and the exterior of the packaging.

This pressure variation has numerous disadvantages. On one hand, hermetic sealing of the packaging can be compromised leading to a risk of leakage of the cosmetic composition due to excessive internal pressure, or of contamination of the cosmetic composition due to internal low pressure. Furthermore, low pressure created by movement of the wall of the cover during opening of the packaging risks detaching the cosmetic composition and carrying it outside of its housing. Moreover, compression of the air tends to work against closing of the packaging, while external pressure not balanced by an equivalent internal pressure tends to work against opening of the packaging. This pressure variation occurs for containers with a sealed compartment.

Cosmetic compositions based on wax and emulsions of fatty material can advantageously be refilled within a container, particularly in the case of foundations, lipsticks, rouges or creams, by-products based on solvents, such as water, volatile silicones, alcohols or mixtures of them. These types of products require for their storage a packaging with a sealed compartment.

The sealed packagings for cosmetic compositions of known type have an elastomer seal with compression having an axial component. These packagings have numerous disadvantages. The sealed quality is only ensured if the elastomer seal is compressed with a relatively high force, making the closing of the packaging difficult or not very reliable. Furthermore, the packaging has a high price, due not only to the use of an expensive seal, but also due to difficulties of automation of the positioning of a non-rigid part, such as an elastomer seal.

One other problem with sealed cosmetic packaging concerns refills. Production of a packaging of a cosmetic composition by placing a refill inside a housing is known. The positioning and holding of the refill is not always easy. Moreover, the volume of the container receiving the refill increases the space requirement of the packaging. Furthermore, it is not always easy to ensure the temporary hermetic sealing of a sealed compartment of a refillable packaging for a cosmetic and/or pharmaceutical composition produced based on a volatile solvent.

SUMMARY OF THE INVENTION

One embodiment of the present invention includes a cover for a packaging for a cosmetic and/or pharmaceutical composition. The cover comprises means of attachment on a container of the packaging and a sealing wall for sealing an opening of the container. The sealing wall is a flexible wall that is elastically deformable by a difference in pressure exerted on its two main sides.

Another embodiment of the present invention includes a packaging for a cosmetic and/or pharmaceutical composition. The packaging comprises a container for receiving the cosmetic and/or pharmaceutical composition and a cover with an elastic deformation. The elastic deformation occurs as a result of a difference between internal pressure predominating in the container and an external pressure that at least partially balances the pressure differences on the sides of the flexible wall.

One other embodiment of the present invention includes a cosmetic and/or pharmaceutical composition disposed in packaging that has a ventilated compartment and some means of application of cosmetic and/or pharmaceutical composition of the sponge or Japanese foam type.

Another embodiment of the present invention includes a sealed packaging for cosmetic or pharmaceutical compositions. The sealed packaging includes a sealed compartment defined by a container and a fitted cover characterized by radial walls that are arranged a distance d apart from one another. One of the walls is provided with an annular rib having a radial extent in a direction of the other wall which is greater than d, in such a way as to exert on the opposite wall a radial force ensuring temporary hermetic sealing of the sealed compartment of the packaging.

Another embodiment of the present invention includes a refillable packaging for a cosmetic and/or pharmaceutical composition which has an external envelope wherein the external envelope is provided with an opening for receiving a container of a refill of cosmetic and/or pharmaceutical composition. The packaging further comprises an opening of the container that opens inside external envelope and means of locking the container of the refill in position in the packaging.

One additional embodiment of the present invention includes a process for packaging a cosmetic and/or pharmaceutical composition. The process includes filling a container of a refill with cosmetic and/or pharmaceutical composition. The process also includes assembling the container of the refill containing cosmetic and/or pharmaceutical composition with a packaging.

DETAILED DESCRIPTION

Figure 1A:
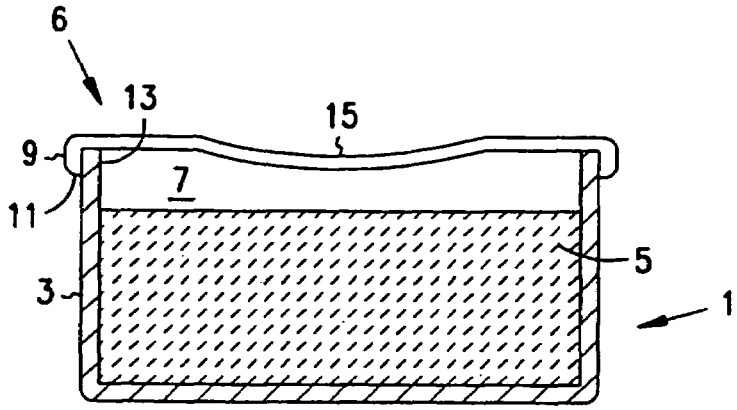
FIG. 1*a* is a view in cross-section of a first example of execution of a packaging according to the present invention subjected to excessive external pressure.

One embodiment of the present invention includes a packaging with a sealed compartment with substantially no leakage of a cosmetic and/or a pharmaceutical composition due to excessive internal pressure, or of contamination due to excessive internal pressure. Furthermore, with the packaging of the present invention, there is no risk of flow of the composition during opening, closing or operation of refilling of the packaging. The packaging is easy to open and close. The packaging has a sealed compartment closed by a cover which is provided with a wall which can be deformed, preferably elastically, by a difference between the internal pressure predominating in the sealed compartment and the external pressure.

Other embodiments of the present invention include packaging which allows for automated assembly and automatic filling, particularly at high temperatures, greater than 50 degrees Centigrade, typically between 75 and 100 degrees Centigrade. Incomplete or incorrect closing of the packaging is virtually impossible. The packaging is therefore reusable.

One embodiment of the present invention includes a cover for a packaging for a cosmetic and/or pharmaceutical composition such as foundation, cream, rouge or lipstick, which has a mechanism for attachment onto a container of the packaging and a wall for sealing an opening of the container, characterized by a flexible sealing wall which is deformed elastically by a difference in pressure exerted on its two main sides. The cover displays an elastic deformation caused by a difference between the internal pressure predominating in the container and the external pressure that at least partially balances this pressure difference.

Another embodiment of the present invention includes a packaging wherein the cover has a wall extending at least locally facing a wall of the container and wherein the side of the wall of the cover facing the wall of the container is provided with a radial rib whose radial extent is greater than the distance between the two walls facing one another so as to ensure, by radial contact, temporary hermetic sealing of the sealed compartment of the packaging.

One sealing wall embodiment comprises a wavy wall that includes concentric patterns in wave form increasing the flexibility of the wall in a direction normal to the opening to be sealed.

One other packaging embodiment comprises a box with a small thickness when it is provided with a middle platform, delimiting an upper ventilated compartment and a sealed compartment for receiving a cosmetic and/or pharmaceutical composition, and wherein the platform forms a cover for the latter compartment.

Another packaging embodiment includes a mechanism for receiving a removable container forming a refill of cosmetic and/or pharmaceutical composition. The packaging has a receiving opening and some mechanism of locking in position, particularly by clipping, of a removable container in the form of a trough or cup, whose opening opens inside the packaging. Some packaging embodiments further include a ventilated compartment, some mechanism of application of the cosmetic and/or pharmaceutical composition of a sponge or Japanese foam type.

One other packaging embodiment for cosmetic compositions according to the present invention includes a sealed compartment defined by a container and a cover which are associated, having radial walls arranged at least locally a distance d apart from one another. One of these walls is provided with an annular rib having a radial extent in the direction of the other wall which is greater than d, which is capable of exerting on the opposite wall a radial force ensuring temporary hermetic sealing of the sealed compartment of the packaging. It is well understood that the distance d at rest can be zero. The diameter of the external side of the wall of the cover can be greater than the diameter of the internal side of the container. In this case, during assembly, the external side of the wall of the cover and the rib separate the walls from one another. This packaging is capable of receiving refills.

For some embodiments, the cover of the packaging constitutes the cover of the sealed compartment. The sealed compartment is for cosmetic compositions based on volatile solvents and a ventilated housing for storage of a mechanism of application, such as a Japanese foam or a sponge, which are better maintained in a dry atmosphere. In this case, the packaging according to the present invention comprises an intermediate platform between the cover of the packaging and the sealed compartment. In both cases, the cover of the compartment is advantageously flexible and/or deformable so as to ensure, by the deformation of the cover of the sealed compartment with respect to the external pressure.

The platform delimits a chamber for receiving the cosmetic and/or pharmaceutical composition and a ventilated compartment for receiving the mechanism of application of the cosmetic and/or pharmaceutical composition. The platform ensures hermetic sealing of the container of the refill. The platform can be deformed so as to allow compensation for the difference in pressure between the interior and the exterior of the container of the refill.

A wall of application of the annular rib or the wall bearing the annular rib corresponds to a wall of the container of the sealed compartment filled with the cosmetic composition. The compartment is provided with a first wall delimiting a container for receiving the cosmetic composition and a second wall, radially external with respect to the first wall, bearing the annular rib or serving as support surface for this rib. Thus, the support of the rib is prevented from separating the wall of the container for receiving the cosmetic composition from this composition, which would promote its detachment.

One other embodiment of the present invention includes sealed packaging having a locking mechanism that locks the packaging in a closed state in which the compartment is hermetically sealed. The annular rib is arranged on a radially external side of the wall of the cover arranged opposite a radially internal side of a wall of the container. In one embodiment, the container has two parallel or roughly parallel walls. The rib is applied on or by the radially external wall of the container to ensure hermetic sealing. The first wall delimits a chamber for receiving the cosmetic and/or pharmaceutical composition and the second wall for application of the mechanism of hermetic sealing of the container of the refill.

Another embodiment includes a refillable packaging for a cosmetic and/or pharmaceutical composition, which has an external envelope, characterized by an opening for receiving a container of a refill of the cosmetic and/or pharmaceutical composition and an opening of the container opens inside the external envelope, and by a mechanism of locking the container of the refill in position in the packaging. One mechanism for locking comprises projecting elements ensuring the locking and holding by clipping of the container of the refill in the packaging.

The container of the refill has a wall with an undercut shape delimiting a chamber for receiving the cosmetic and/or pharmaceutical composition. For some embodiments, the packaging comprises a flat box and the container of the refill is a trough or a well.

For one packaging embodiment, the opening is made in a base of the external envelope of the packaging and the external wall of the bottom of the container of the refill is in the extension of the external side of the base of the envelope of the packaging.

The present invention also includes a process for packaging a cosmetic and/or pharmaceutical composition. The process includes filling a container of a refill with a cosmetic and/or pharmaceutical composition and assembling the container of the refill containing the cosmetic and/or pharmaceutical composition with the packaging. Filling may occur while the cosmetic and/or pharmaceutical is hot. The filling may occur by pressing the cosmetic and/or pharmaceutical.

Figure 1B:
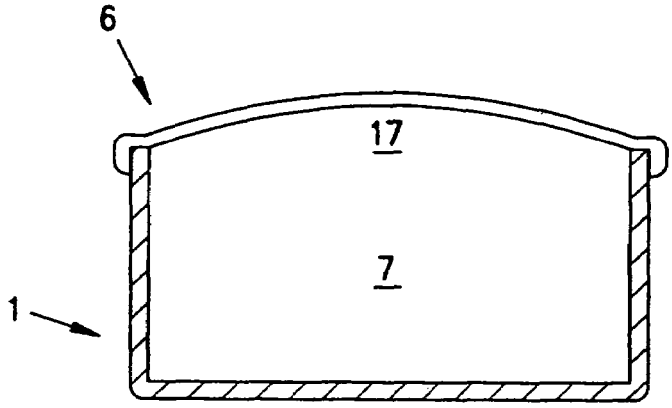
FIG. 1*b* is a cross-sectional view of the packaging of FIG. 1*a* subjected to low external pressure.

FIGS. 1*a* and 1*b* illustrate one embodiment of packaging 1, according to the present invention, which has, for example, container 3 of cosmetic and/or pharmaceutical composition 5, for example, of the pot, trough, cup or other type. Container 3 is provided with cover 6 ensuring the hermetic sealing of internal chamber 7 of packaging 1.

Cover 6 has a mechanism held on container 3, for example, of a roughly cylindrical wall 9 provided with threading 11 fitted to threading 13 of the upper end of packaging 1 and wall 15 for sealing of opening 7 of container 3. In FIG. 1, wall 15 is flexible so that it can be advantageously elastically deformed by a difference in pressure predominating on its two main opposite sides. Flexibility is given to wall 15 by its small thickness, by the use of a flexible material or by its structure. In FIG. 1*a*, the external pressure was greater than that predominating inside chamber 7 of packaging 1, causing deformation of wall 15 towards the interior of chamber 7. Seen from the outside, wall 15 is concave. The deformation of wall 15 makes it possible to balance or at least to reduce the imbalance of the pressures.

The deformations of wavy wall 15 ensure compensation for the differences in the pressures against the two main sides. One thus avoids suction of cosmetic composition 5 by low pressure caused by opening of the box according to the present invention, compression of the cosmetic composition due to closing of the box, as well as sealing problems connected with variations in atmospheric pressure which varies with meteorological conditions and with altitude, as well as that connected with the creation of low pressure or excessive pressure in rooms such as pressurized cabins of aircraft. Moreover, the internal pressure is less of a hindrance to closing of the packaging according to the invention, and the external pressure works against opening of the packaging to a lesser extent.

In contrast, in the case illustrated in FIG. 1*b*, the internal pressure of chamber 7 was higher than the external pressure. This resulted in swelling of flexible membrane 15, a membrane which, seen from the outside, has a convex surface. Deformation of flexible membrane 15 made it possible to balance the pressures or at least reduce the imbalance.

Figure 2:
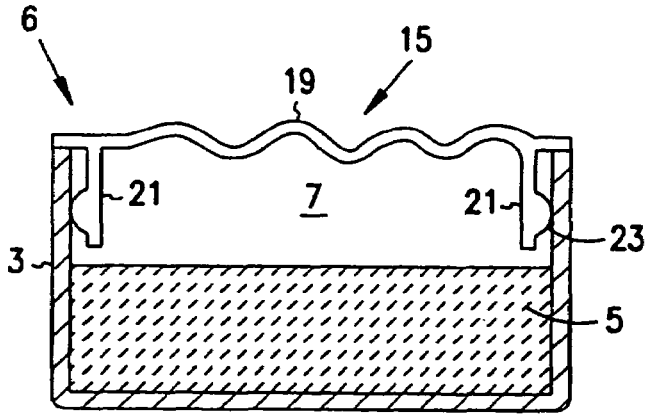
FIG. 2 is a view in cross-section of a second example of execution of a packaging according to the present invention.

In FIG. 2, is an embodiment of packaging 1 which has a cover 6 which has wavy wall 15 whose concentric waves 19 facilitate deformation. The cover has wall 21 arranged parallel to the upper part of packaging 1. The distance between the radially internal side of the upper part of container 3 and the radially external side of wall 21 is advantageously constant or roughly constant. This distance is typically between a few tenths and a few hundredths of a mm. The radially external side of wall 21 bears annular rib 23 whose thickness in the non-constrained state is greater than the average distance between the radially external side of wall 21 and the radially internal side of container 3. For example, for a distance between sides facing one another equal to 0.1 mm, annular rib 23 has a radial projection of 0.3 mm so that the radial forces exerted by rib 23 on the radially internal side of container 3 correspond to a deformation of wall 21 of 0.2 mm on each side in such a way as to ensure temporary hermetic sealing of chamber 7. As a variant, at rest, the diameter of opening 7 is greater, for some embodiments, than the diameter of the radially external side of wall 21. In this case, cover 6 is introduced by force and rib 23 separates the walls facing one another. Introduction is advantageously facilitated by a widened zone at the opening.

Figure 4:
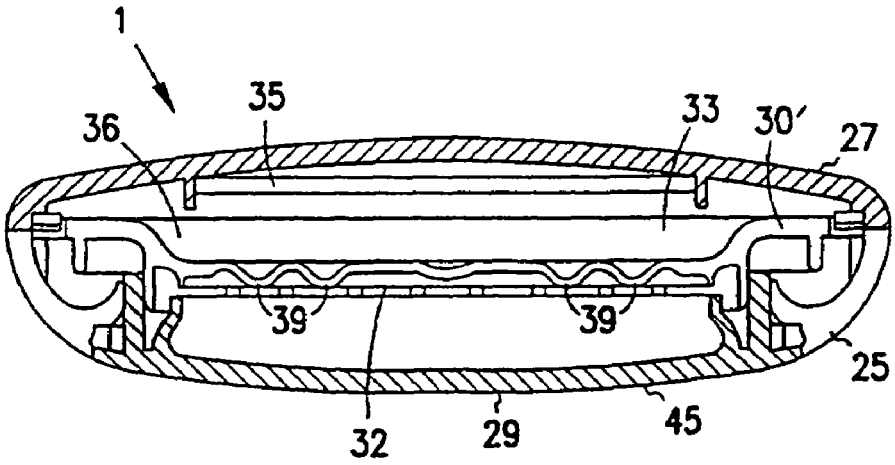
FIG. 4 is a view in cross-section of the packaging of FIG. 3.

In FIG. 4, one can see an embodiment of packaging 1 in a form of a relatively flat box having lower part 25 and upper part 27. Lower part 25 has central opening for receiving refill 29 in a form of a trough or cup whose attachment on the box is ensured by a conventional mechanism such as, for example, by screwing, for example, over a quarter turn, or advantageously, by catching. Refill 29 receives, for example, in a hot filling line, typically 80 degrees C, a cosmetic composition such as, for example, a foundation, a rouge, or a lipstick produced based on a volatile solvent such as water.

Figure 5:
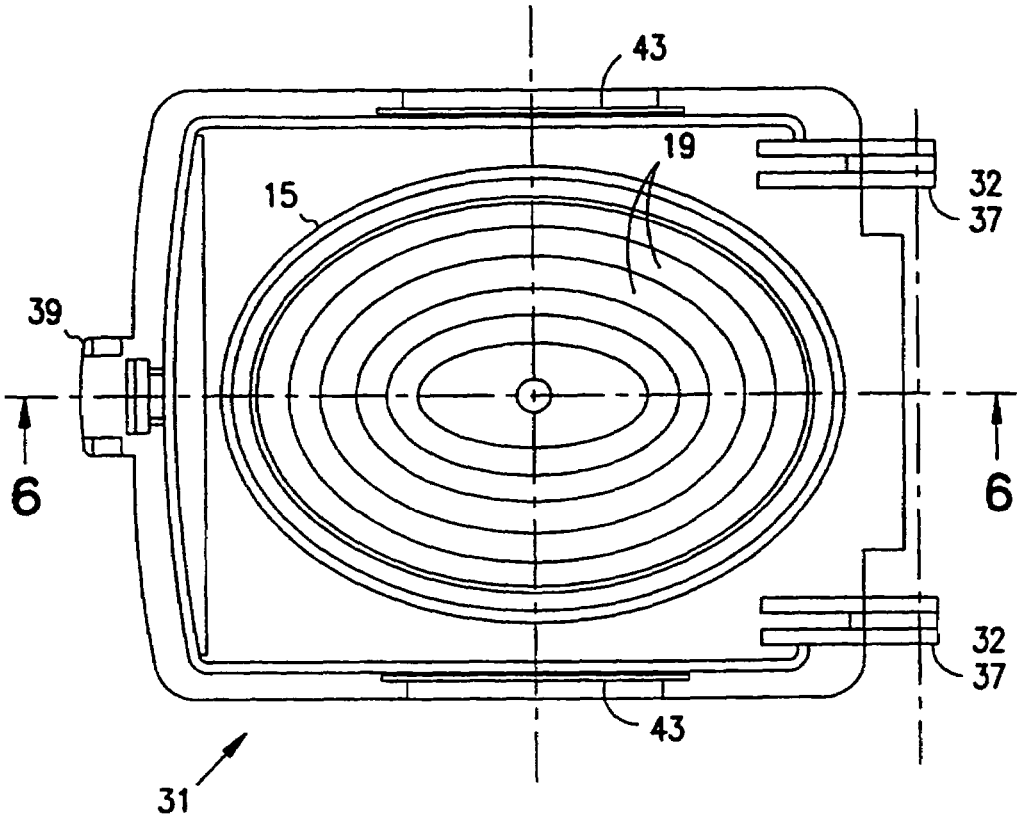
FIG. 5 is a top view of a platform forming a cover of the packaging of FIG. 3.
Figure 6:
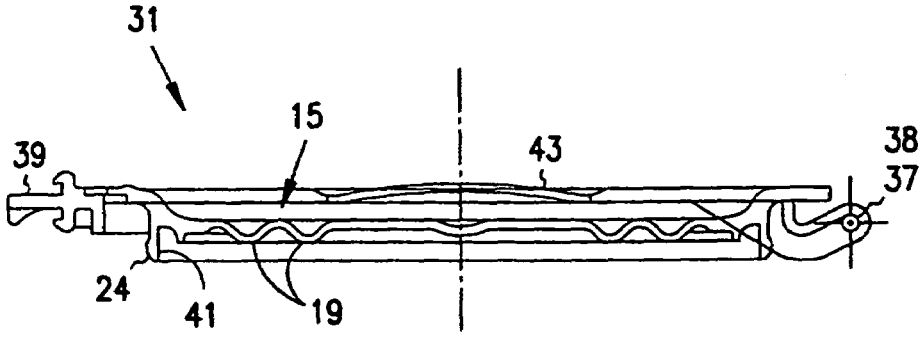
FIG. 6 is a view in longitudinal section according to VI-VI of the platform of FIG. 5.

Platform 31, embodiments of which are illustrated in FIGS. 5 and 6, ensures the hermetic sealing of refill 29 and delimits chamber 33 which is ventilated by openings which are not represented, for storage of some mechanism of application of the cosmetic composition, for example, a sponge or Japanese foam. This embodiment prevents degradation of the mechanism of application by humidity and particularly the formation of mold. Chamber 33 receives mirror 35. Other non-refillable boxes having a single-piece lower part 25 incorporating walls which delimit chamber 7 is not outside the scope of the present invention.

Advantageously, lower part 25, platform 31 and upper part 27 are articulated by a hinge mechanism 37. Refill 29 advantageously has an undercut shape, i.e. its opening has a width smaller than that of its widest part. Consequently, on one hand, the refill tends to retain a cosmetic composition if packaging 1 is overturned. On the other hand, the narrow walls of refill 29 at the site of the opening provide optical masking of possible detachment of the cosmetic composition with respect to the walls at the bottom, due to evaporation of the solvent in case of prolonged opening of the packaging. The undercut shape of refill 29 also makes it possible to mask the shrinkage of the cosmetic composition which is poured hot into the refill, during its shrinkage due to a cooling phase.

Figure 19:
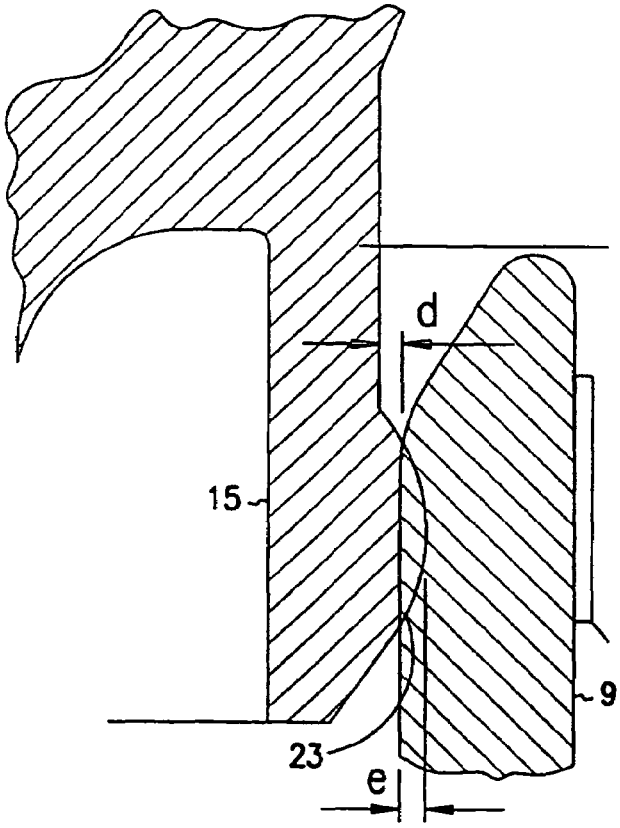
FIG. 19 is a view on a larger scale of the packaging of FIG. 15.

Advantageously, refill 29 has a hermetic sealing wall radially external with respect to the undercut wall defining chamber 7. The radially internal side of the radially external wall of refill 29 forms a support surface for annular rib 23 which ensures temporary hermetic sealing. Consequently, the external radial forces exerted by rib 23 are only partially transmitted to the undercut wall, which considerably limits the risk of detachment of the cosmetic composition form this undercut wall, as shown in FIGS. 3 and 19.

Figure 3:
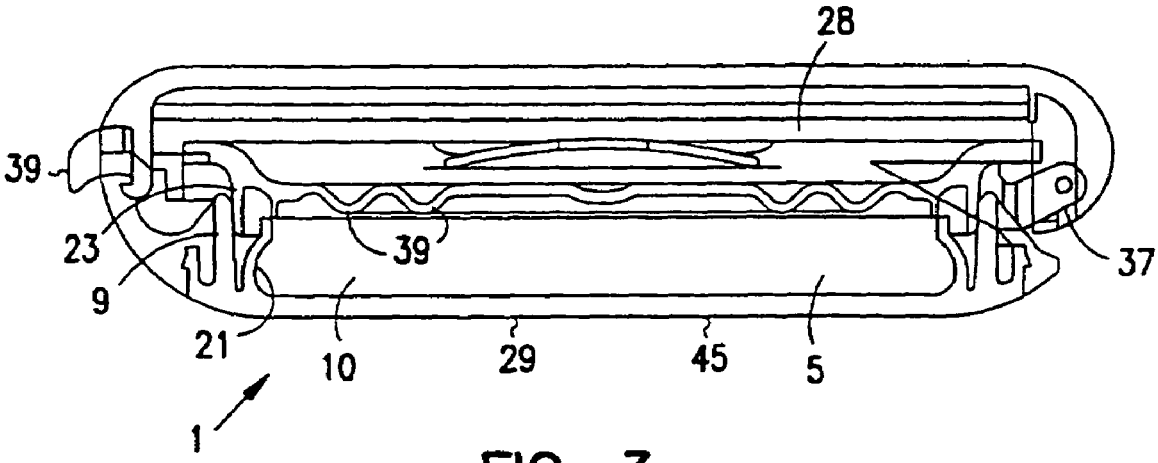
FIG. 3 is a view in longitudinal section of one embodiment of execution of a packaging according to the present invention.

Packaging 1 according to the present invention advantageously has some mechanism for locking 39 with a pusher and hooks, shown in FIGS. 3 and 5. The cover 6 for trough or well 10, shown in FIG. 21, ensures hermetic sealing between two uses.

Advantageously, the sealing is ensured by rib 23 whose thickness in the non-constrained state is greater than the distance between the radially external side of the wall of platform 28, shown in FIG. 3, and the radially internal side of the external wall of trough or well facing it. For example, a distance between sides facing one another equal 0.1 mm, rib 23 having a radial projection of 0.3 mm in such a way that the radial forces exerted by rib 23 on the wall facing it correspond to a deformation of 0.2 mm which ensures hermetic sealing of trough or well 10. It should be noted that rib 23 exerts forces which have a radial component, the axial components being zero or roughly zero when the packaging is closed. During closing, the very weak axial forces correspond to friction of rib 23 of the internal side of external wall 21 of trough or well 10. Consequently, on one hand, it is possible to provide excellent sealing of the packaging according to the present invention without having to exert great axial forces, and other the other hand, the reaction to the axial forces being themselves zero or roughly zero, the seal does not tend to cause the packaging according to the present invention to open.

Moreover, the seal is completely ensured regardless of the depth to which the cover is pressed in. A temporary sealing of the packaging according to the invention results, even in the case the precision of assembly of the pieces of the packaging was not perfect.

Advantageously, upper part 27 is provided with space 36 which is ventilated by openings, not shown, for storage of the mechanism of application of the cosmetic composition, for example, a sponge or a Japanese foam. One thus prevents degradation of the mechanism of application by humidity and particularly the formation of mold. Space 36 can receive mirror 35.

Figure 13:
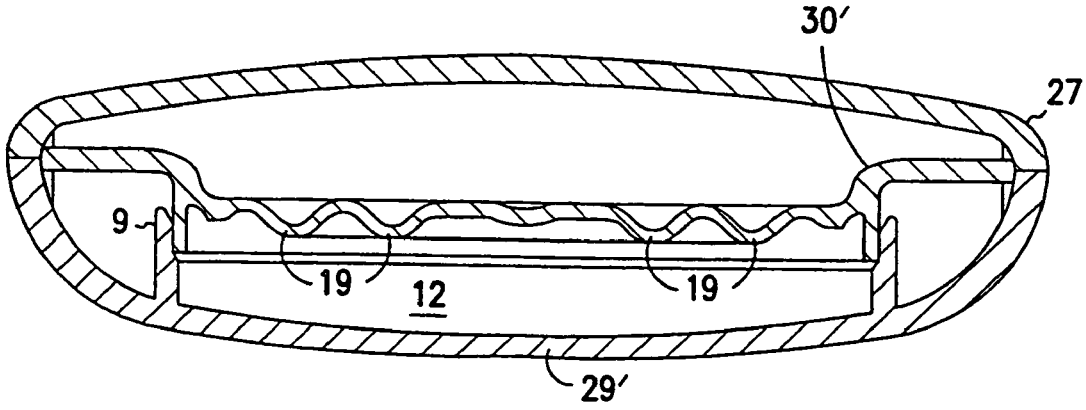
FIG. 13 is a cross-sectional view of one other embodiment of packaging of the present invention.

Advantageously, platform 30', shown in FIGS. 4 and 13, is deformable by a difference in pressure predominating over that of the opposite side in order to ensure compensation for this difference in pressure. One thus avoids suction of the cosmetic composition by a low pressure brought about by opening of the box according to the present invention, compression of the cosmetic composition due to closing of the box as well as sealing problems connected with variations in atmospheric pressure which varies with meteorological conditions and with altitude, as well as with low and high pressures created in rooms such as the pressurized cabin of an aircraft. For example, platform 30' has concentric corrugations or waves 37.

The packaging shown in FIGS. 3 and 4 is capable of receiving a refill provided with cosmetic composition 5, for example, of the foundation, rouge or lipstick type. The bottom of trough or well 10 is made rough or having striations which promote adhesion of the cosmetic composition 5. The box of FIGS. 3 and 4 has lower part 25 and upper part 27 separated by platform 30' which is advantageously provided with a seal ensuring the sealing of trough or well 10 arranged in lower part 25.

FIGS. 5 and 6 illustrate platform 31. The platform has a roughly rectangular shape, bearing in its center wavy elliptical wall 15 with concentric waves 19 facilitating deformation of wall 15. Wall 41, roughly normal to wall 15 is provided with radial projection 24 ensuring the sealing of chamber 7 during its application on the radially internal side of the radially external wall of refill 29. The platform 31, is, for some embodiments, provided with elastic return elements or leaf springs 43 ensuring the positioning of the platform in the box of FIGS. 3 and 4.

The packaging of the present invention is produced out of plastic material. Suitable materials include styrene butadiene, polypropylene, ABS or styrene acrylonitrile (SAN) for boxes with a glossy appearance. Platform 31 is produced, for example, out of polypropylene or polyethylene and an additive for improving elastic flexibility. For platforms of small thickness, more rigid plastic materials are usable, such as ABS or styrene.

Figure 7:
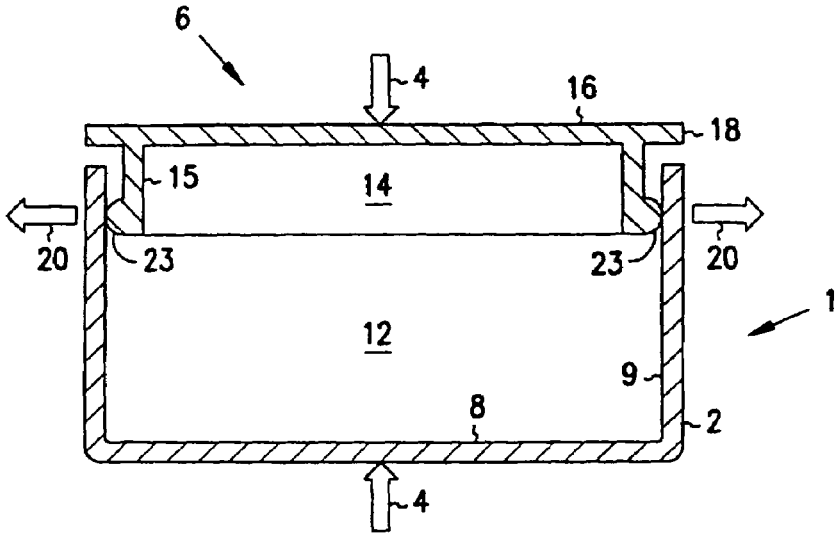
FIG. 7 is a cross-sectional view of one embodiment of a packaging according to the present invention.
Figure 8:
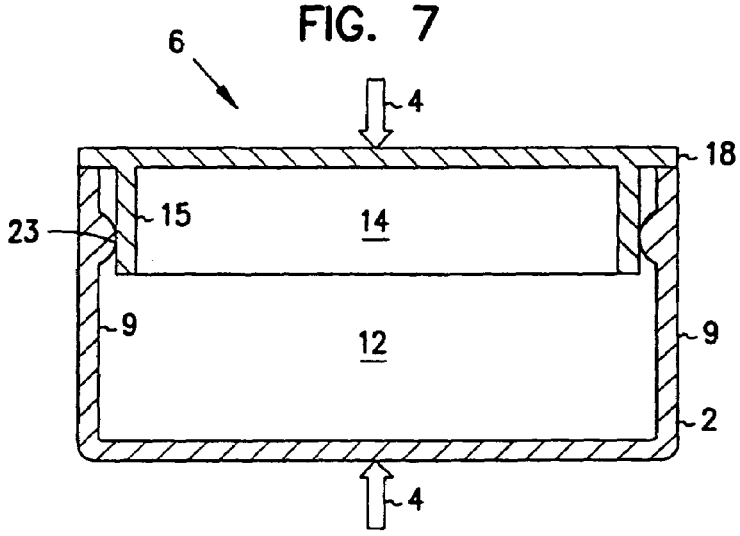
FIG. 8 is a cross-sectional view of another example of execution of a packaging according to the present invention.

In FIG. 7 is a packaging which has a container 1, cover 6 and a mechanism of locking in a closed state of the packaging which are symbolized by arrows 4. Container 1 has bottom 8 and cylindrical wall 9, with an elliptical, oval, polygonal or other shaped base. Wall 9 is vertical or roughly vertical, at least in its part near opening 14 of chamber 12 for receiving the cosmetic composition of container 1. Cover 6 has wall 16 for closing opening 14, wall 15 configured to the internal side of the upper part of wall 9 of the container, and a mechanism 18 for limiting the course of travel for preventing cover 6 from being pressed inside of container 1. Wall 15 is advantageously arranged parallel to the upper part where the temporary hermetic sealing of wall 9 is established, that is to say that the distance between the radially internal side of wall 9 is established. That is, the distance between the radially internal side of wall 9 and radially external side of wall 15 is constant or roughly constant. The distance is typically between a few tenths and a few hundredths of a millimeter. The external side of wall 15 bears annular rib 23 whose thickness in the nonstressed state is greater than the average distance between the radially external side of wall 15 and the radially internal side of wall 9. For example, for a distance between the sides opposite one another of walls 9 and 15 equal to 0.1 mm, annular rib 23 has a radial projection of 0.3 mm so that radial forces, symbolized by arrows 20, exerted by rib 22 on the radially internal side of wall 9 correspond to a deformation of wall 15 of 0.2 mm on each side. Radial forces 20 ensure the sealing of sealed compartment 14. It should be noted that forces 20 are exerted only in the radial direction. The axial components are zero or roughly zero when cover 6 is positioned on container 1. During introduction, the very weak axial forces correspond to friction of rib 23 on the internal side of wall 9. This results in the fact that, on one hand, it is possible to ensure excellent sealing of the packaging according to the present invention without having to exert extensive axial force, and, on the other hand, since the reaction to the axial forces is itself zero or roughly zero, the seal formed by walls 9, 15 and annular rib 23 does not tend to cause packaging 1 to open. In FIG. 8, annular rib 23 is borne by the internal side of wall 9 opposite the external side of wall 15.

In an embodiment illustrated in FIG. 8, cover 6 has wall 15 which is radially external with respect to wall 9 of container 1. Cover 6 exerts a force of constriction on wall 9 of container 1 which promotes application of this wall on its contents, in particular, on a cosmetic composition in a pasty state.

Figure 9:
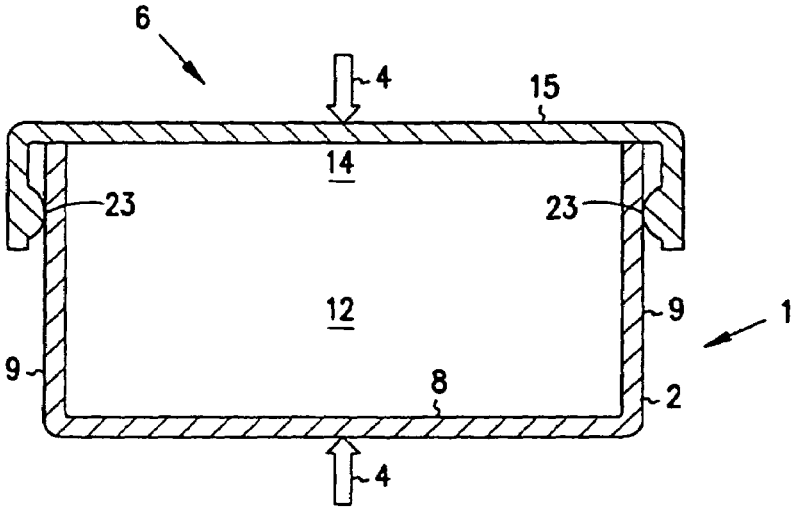
FIG. 9 is a cross-sectional view of another example of packaging of the present invention.

In an example illustrated in FIG. 9, annular rib 23 is borne by the radially internal side of wall 15 of cover 6 and is applied on the radially external side of wall 9 of container 1. The embodiment of FIG. 4 differs from that of FIG. 9 by rib 23 being borne by the radially external side of wall 9 of container 1.

Figure 10:
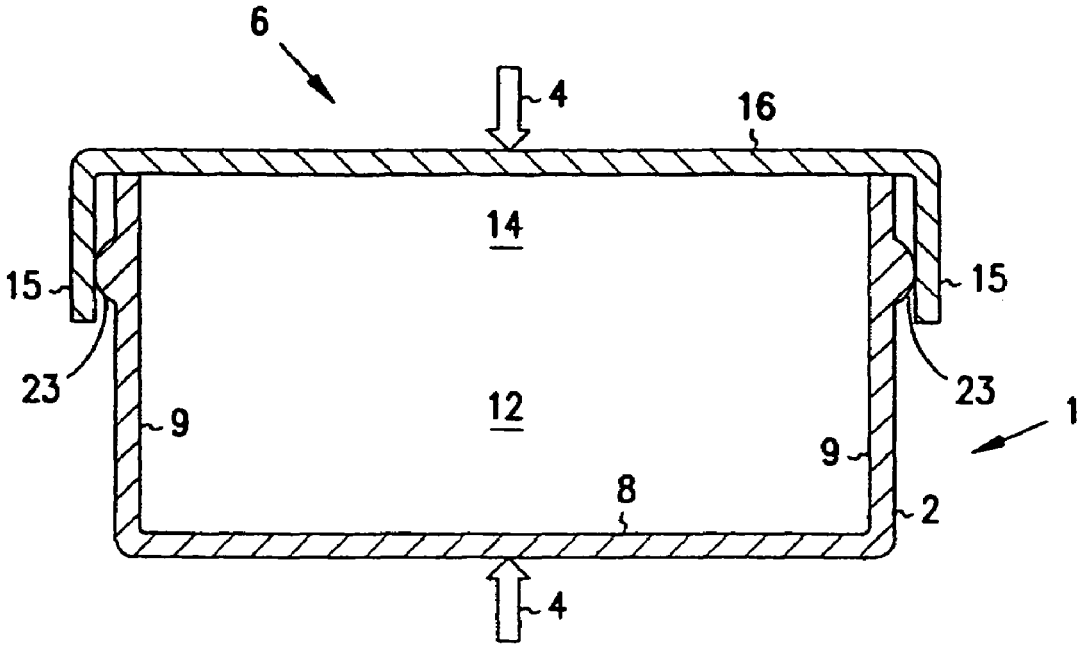
FIG. 10 is a cross-sectional view of one other example of packaging of the present invention.
Figure 11:
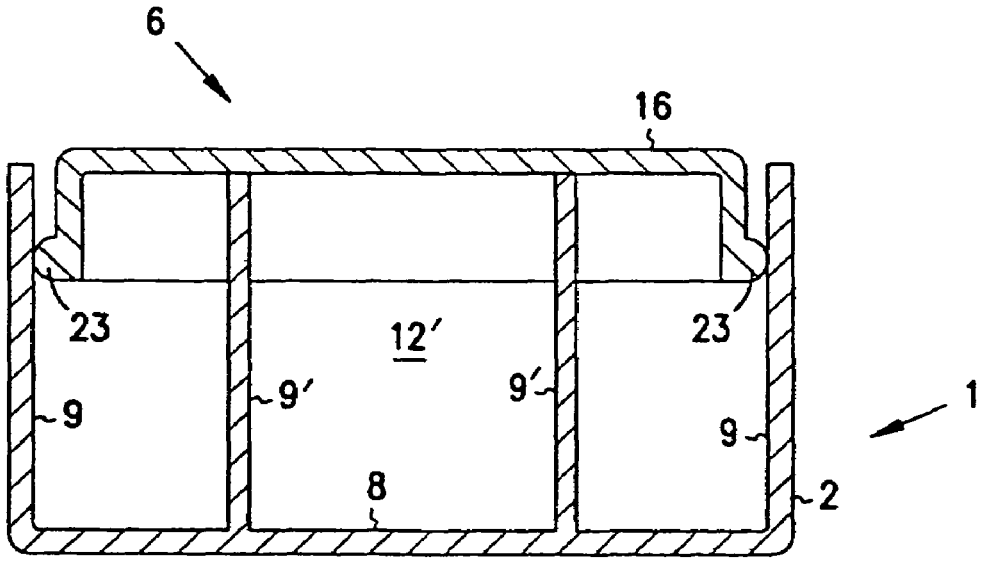
FIG. 11 is a cross-sectional view of another embodiment of packaging of the present invention.

In FIG. 11, one can see an embodiment of packaging which combines features of embodiments in FIGS. 7 and 8 with those of FIGS. 9 and 10. Container 1 of FIG. 11 has chamber 12 for receiving the cosmetic composition, which is delimited by walls 9', a second wall 9 radially external to and connected with wall 9' and/or with bottom 8, in such as way as to form a sealed compartment. The radially internal side of wall 9 forms a support surface for annular rib 19 of cover 6.

Radially external force exerted by rib 23 on wall 9 is only partially transmitted to wall 9', which considerably limits the risk of detachment of the cosmetic composition with respect to walls 9'. It is understood that use of a radially external wall associated with the seal of FIGS. 8, 9 and/or 10 is not outside the scope of the present invention.

Figure 12:
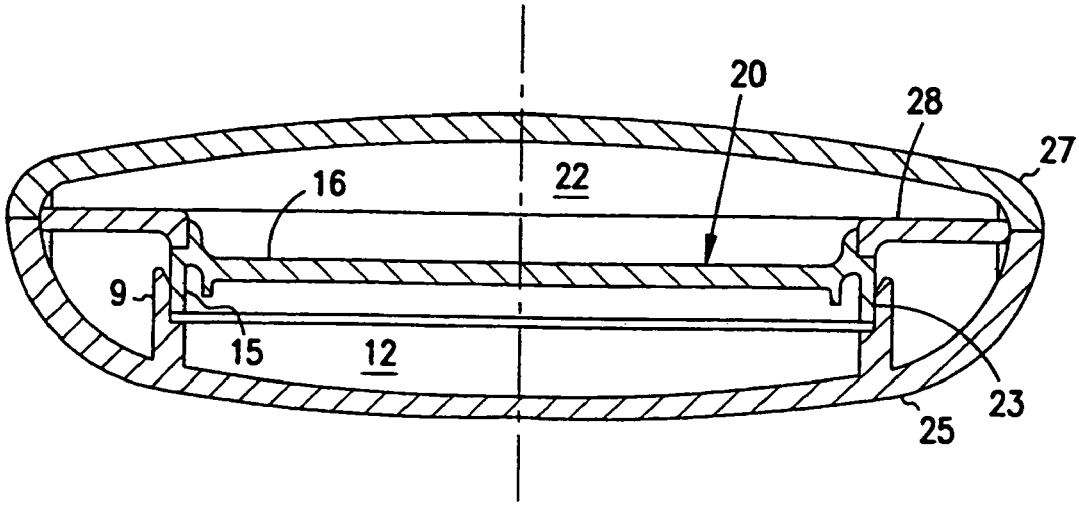
FIG. 12 is a cross-sectional view of another embodiment of packaging of the present invention.

In FIG. 12 is a packaging embodiment, of the box type, which is capable of receiving, in a sealed compartment or chamber 12, a cosmetic composition of the foundation, rouge or lipstick type. The box of FIG. 12 has lower part 25, upper part 27, and intermediate platform 28 provided in its center with an opening provided with sealing disk 26 which seals chamber 12. The various elements are articulated by a hinge mechanism 32 with a single pin, shown in FIG. 15. Some locking mechanisms, such as a hook and pusher, which is not shown, ensure that the box is maintained in a closed state when it is not used. In order to prevent rotation of the cosmetic composition, cylindrical or oval-based wall 9 is set up on the bottom of lower part 25. The bottom of the container is made rough or to have striations to promote clinging of the cosmetic composition. Sealing disk 26, shown in FIG. 12, has a wall extending roughly over the whole extent of opening 12 of sealed compartment 12, as well as wall 15 parallel to wall 9, and provided on its radially external side with annular rib 23 which is applied, in a closed state, on the radially internal sides of wall 9.

For some embodiments, space 22 available above sealing disk 26 forms a chamber which is ventilated by openings, not shown, for storage of the mechanism for application of the cosmetic composition, for example, a sponge or a Japanese foam. Degradation of the application mechanism is prevented by humidity and the formation of mold. Chamber 22 also receives a mirror.

In FIG. 13 is an improved example of a box of the present invention which has a single piece 29' forming the platform and the sealing disk. In one embodiment, single piece platform 29' is deformed by a difference in pressure on its two sides in order to provide compensation for such a pressure. Suction of the cosmetic composition by a low pressure brought about by opening of the box according to the present invention is avoided. Compression of the cosmetic composition due to closing of the box as well as sealing problems connected with variations in atmospheric pressure which varies with meteorological conditions and with the altitude such as connected with low and high pressures created in rooms such as the pressurized cabin of an aircraft. Moreover, the packaging according the present invention is easy to operate, because the internal pressure does not work against its closing, and the external pressure does not work against its opening. An example of deformable wall 29' having concentric waves 19 is illustrated in FIGS. 5 and 6. Platform 29' has hinges 32, with a mechanism of locking with hooks and some mechanism of return 38, in the form of leaf springs, ensuring that the platform is flattened toward opening 14 of container 12.

Figure 14:
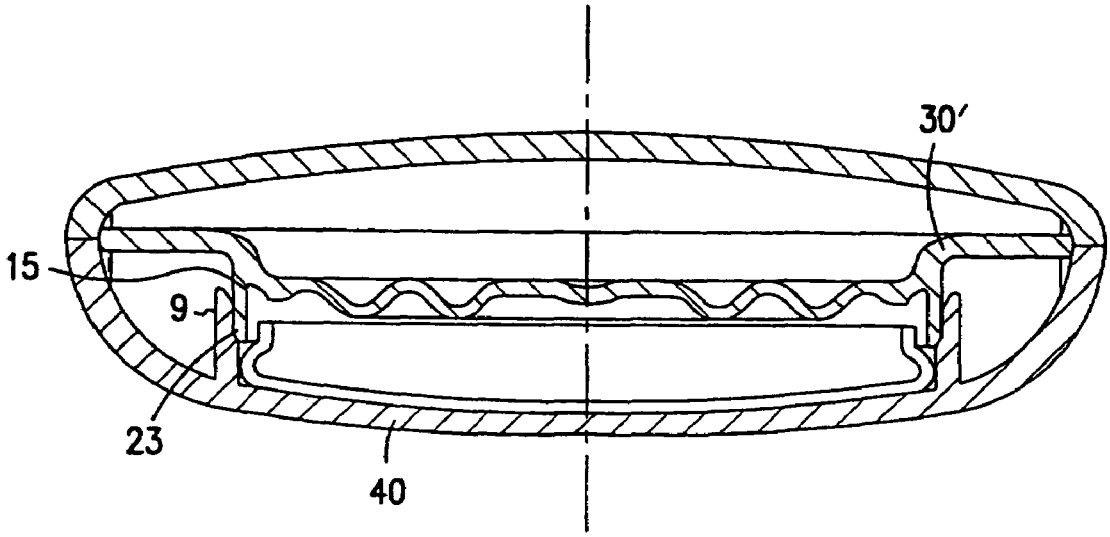
FIG. 14 is a cross-sectional view of another embodiment of packaging of the present invention.

Another embodiment of a box of the present invention is illustrated in FIG. 14. The sealed compartment of the box of FIG. 14 is provided with removable cup 40 which, on one hand, prevents the radially external force exerted by annular rib 23 of wall 15 of platform 30' from detaching the cosmetic composition from the wall of its container. On the other hand, it is easier to fill a cup with a cosmetic composition than to handle, in a filling line, a complex box for filling opening 12 downward at high temperature. Only the plastic cup provided with a temporary packaging such as a cover, a cap, or similar closure is usable to refill a box according to the present invention.

Figure 17:
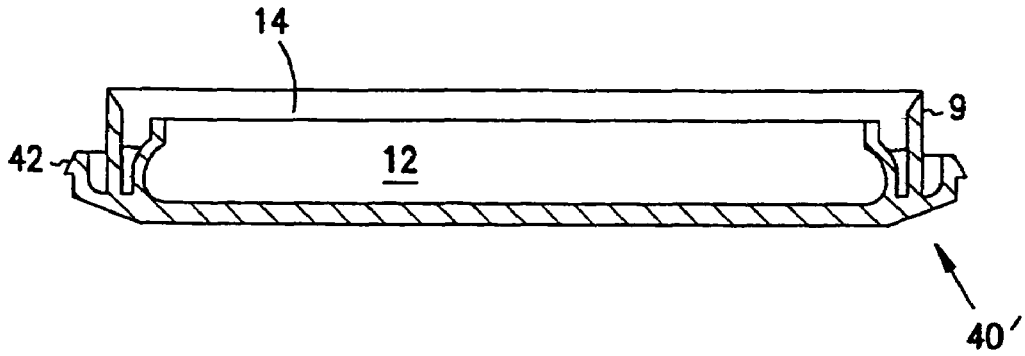
FIG. 17 is a cross-sectional view of a cup of the packaging of FIG. 15.

One cup embodiment has an undercut shape such that its opening 14, shown in FIG. 17, has a width smaller than that of a widened part. Consequently, on one hand, cup 40' tends to retain a product if the box is overturned with opening 14 downward, and on the other hand, the narrow walls of the cup at the site of opening 14 provide optical masking of possible detachments of the cosmetic composition with respect to the walls at the bottom due to evaporation of the solvent in case of prolonged opening of the box, corresponding to a common error of users.

The undercut shape of the receiving cup also makes it possible to mask the shrinkage of the cosmetic composition which is poured hot into the well, during its shrinkage due to a cooling phase.

Figure 15:
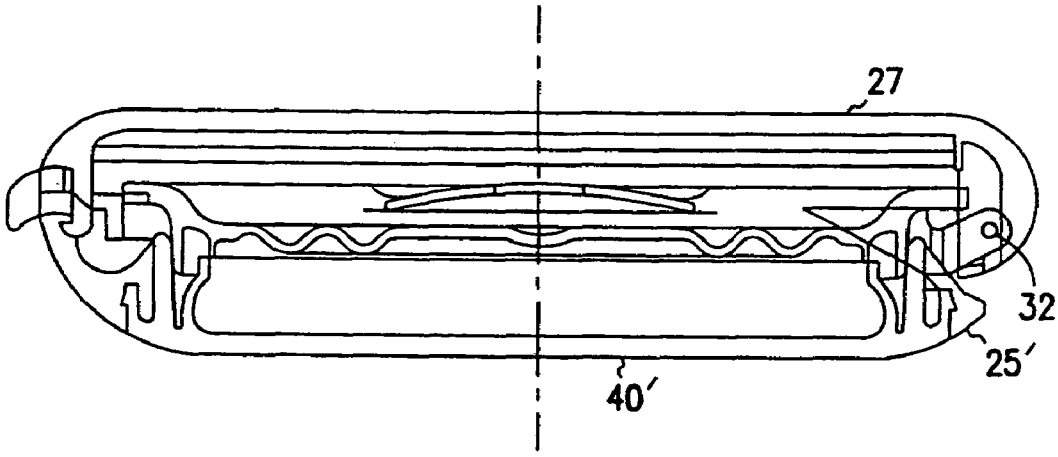
FIG. 15 is a cross-sectional view of another embodiment of packaging of the present invention.
Figure 16:
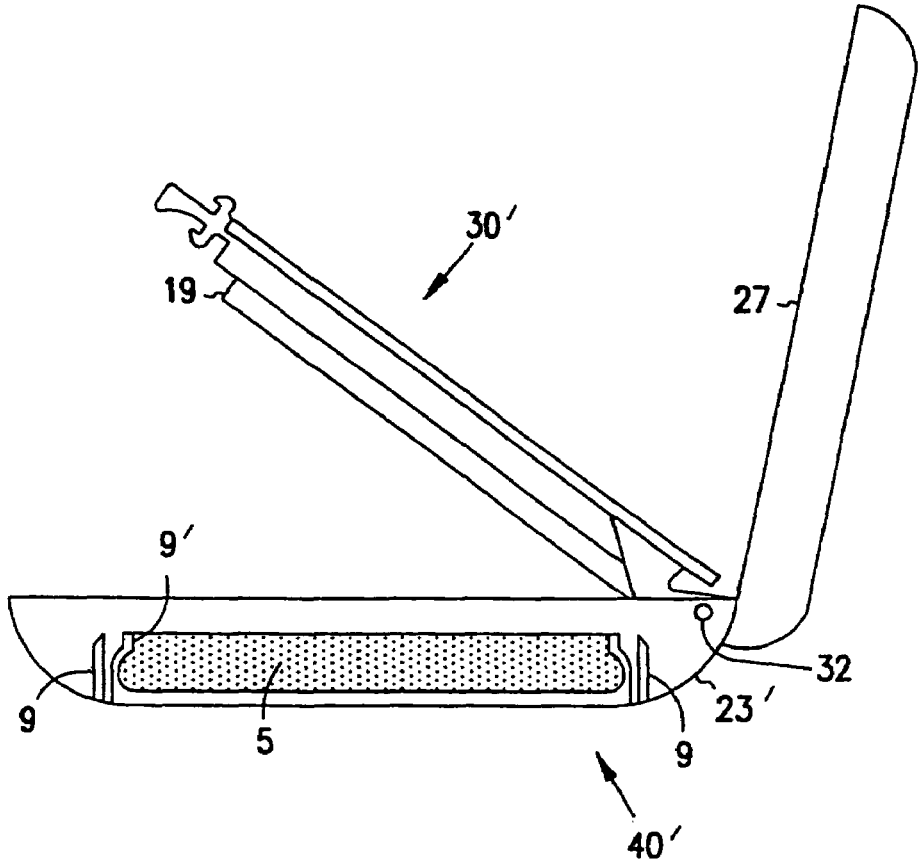
FIG. 16 is a side view of packaging of FIG. 15 in an open state.

In FIGS. 4, 15 and 16, is shown an execution example of box 1 according to the present invention, which has lower part 25' provided with a central opening for receiving cup 40', whose attachment on the box is ensured by any known mechanism, such as by screwing over a quarter turn or by catching. The cosmetic composition 5 is illustrated by the dots in FIG. 16.

Figure 18:
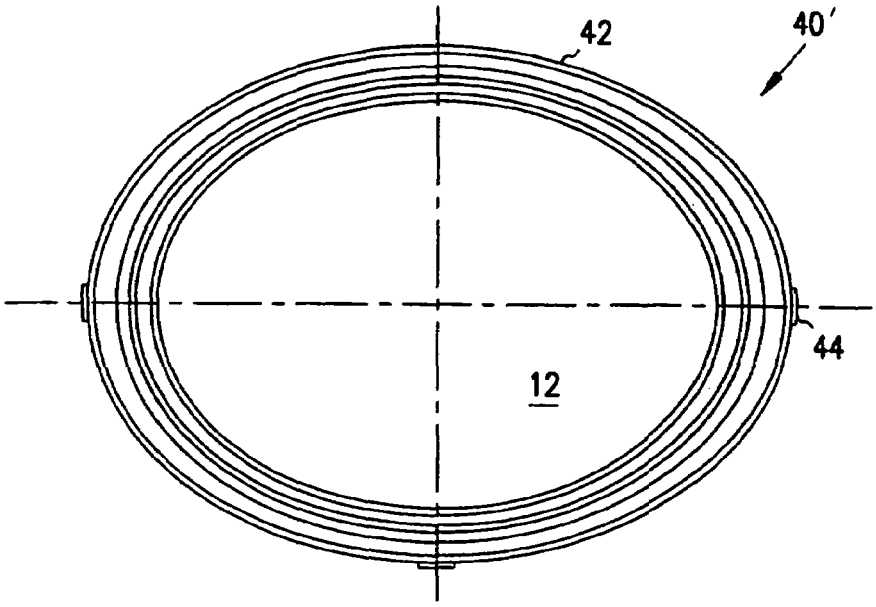
FIG. 18 is a top view of the cup of FIG. 17.

Some embodiments of mechanisms for attachment of cup 40' are illustrated in FIGS. 17 and 18 and have wall 42, radially external to wall 9, provided with securing elements 44, for example, in the form of hooks distributed preferably regularly on the periphery of wall 42. The cup is roughly elliptical and it has four securing hooks 45 arranged at the intersection of the large and the small axis of the ellipse with the external side of wall 42.

The undercut cup is produced by blowing, or with a mold which is opened in two steps: first, the exterior of the mold is released; then a piston ensures the release of the cup with passage of narrow opening 14 through a zone of greater width of the mold by elastic deformation of the plastic material constituting the cup.

In FIG. 19 is an annular rib 23 arranged on wall 15 facing wall 9 a distance d away, for example, equal to 0.1 mm. The intersection between the space occupied by rib 23 in the absence of wall 9 and the wall 9 in the absence of rib 23 having a radial extent e, for example, equal to 0.2 mm. As a variant, at rest, the diameter of opening 14 is less than the diameter of the radially external side of wall 15. In this case, cover 6 is introduced by force and rib 23 separates the opposite walls. Annular ribs may be rounded, polygonal such as triangular or trapezoidal.

Figure 20:
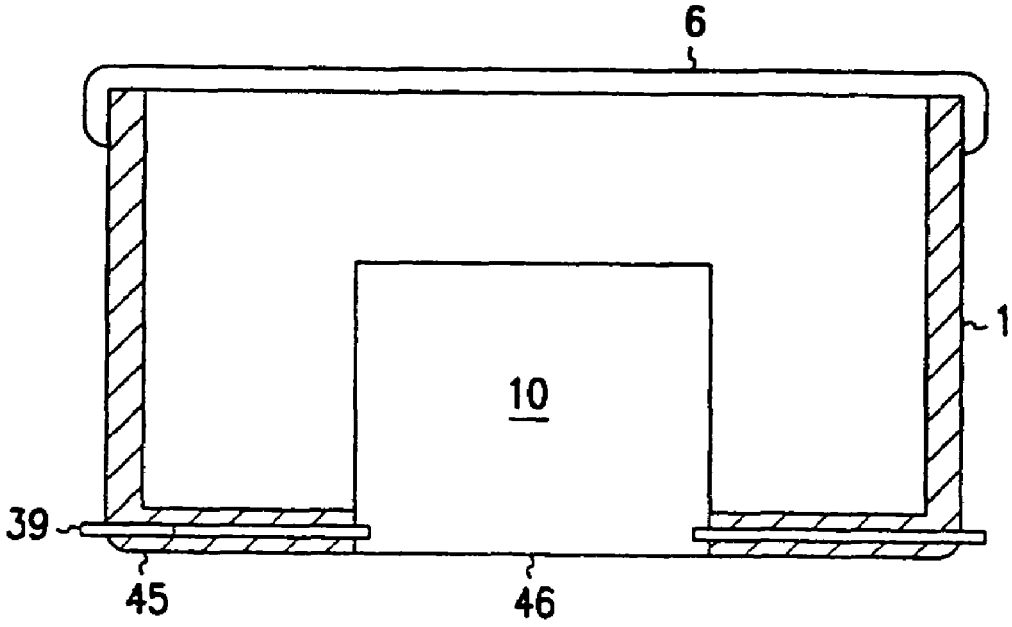
FIG. 20 is a cross-sectional view of one embodiment of packaging of the present invention.

In FIG. 20 is a packaging according to the present invention, which has external envelope 1, for example, cylindrical, elliptical-based, oval, polygonal or other shape, which is closed by cover 6. Base 45 of envelope 1 is provided with opening 46 for receiving refill 29, in particular, within a trough or a well 10 which is capable of receiving a cosmetic and/or pharmaceutical composition. Some mechanism for locking 39, for example, with a screw thread, a set of pins or pegs allowing locking by catching, ensuring that trough or well 10 is assembled with the packaging according to the present invention.

The packaging of FIG. 20 does not ensure hermetic sealing of refill 29. In particular, this packaging offers the risk of passage of fluid at the edges of opening 14 between the edge of base 45 and the wall facing trough or well 10.

Figure 21:
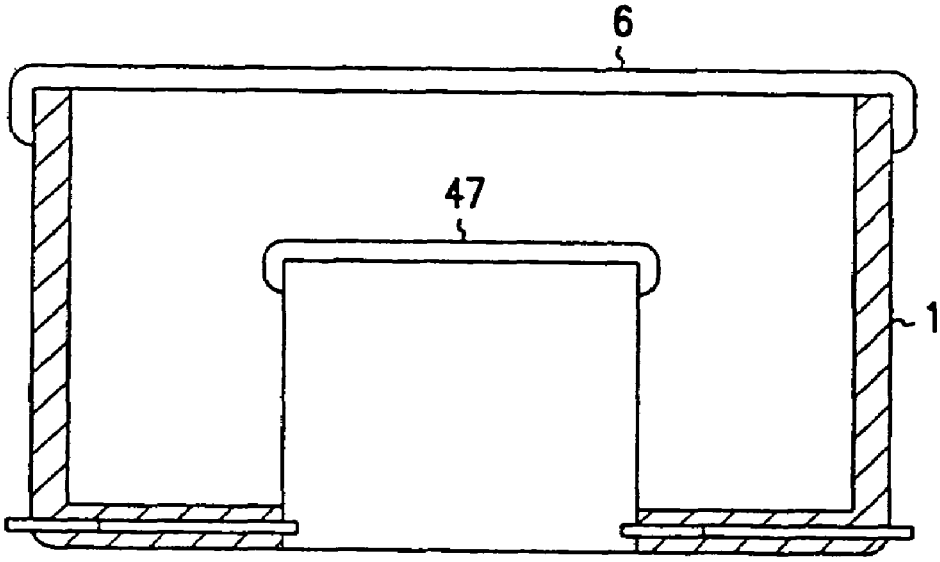
FIG. 21 is a cross-sectional view of another embodiment of packaging of the present invention.

Use of packaging of FIG. 21 requires several operations that include removing cover 6, removing cover 47, taking the desired quantity of the cosmetic and/or pharmaceutical composition, putting cover 47 back on well 10 and putting cover 6 back on the packaging.

Figure 22:
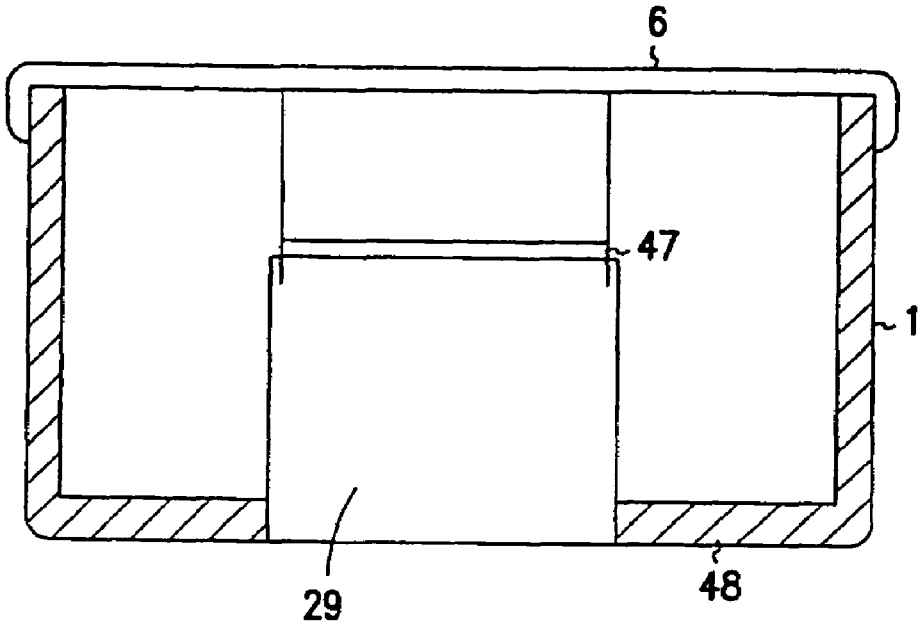
FIG. 22 is a cross-sectional view of another embodiment of packaging of the present invention.

In FIG. 22 is an example of a packaging which has cover 6 provided, for example, in its center with cap 47 which ensures the temporary hermetic sealing of trough or well. Furthermore, an execution example of the packaging illustrated in FIGS. 23, 24 and 25 has a mechanism of locking that comprises pegs 50 and 51, that catch envelope 1 of the packaging which has corresponding grooves.

Figure 23:
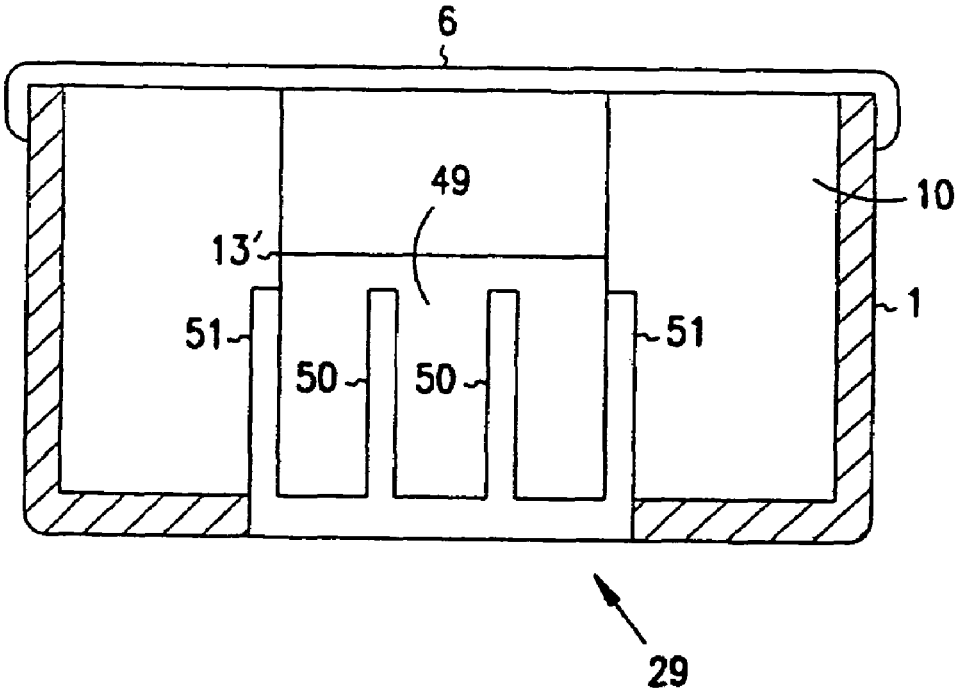
FIG. 23 is a cross-sectional view of another embodiment of packaging of the present invention.
Figure 24:
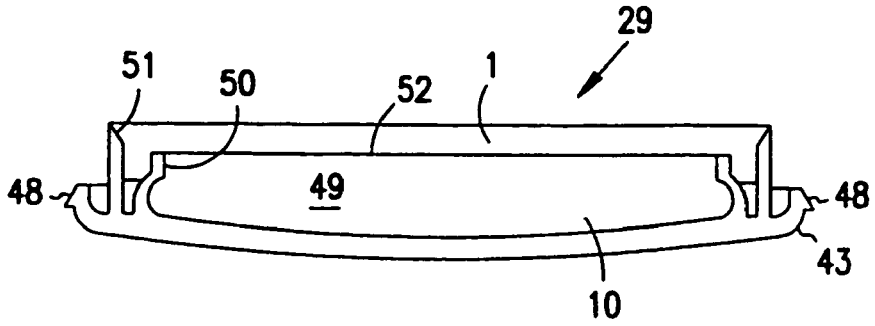
FIG. 24 is a cross-sectional view according to VII-VII of a refill trough of the packaging of FIG. 4.
Figure 25:
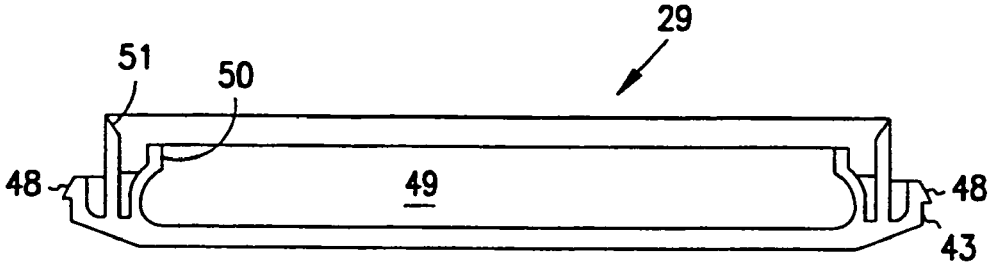
FIG. 25 is a cross-sectional view according to VIII-VIII of a refill trough of the packaging of FIG. 3.
Figure 26:
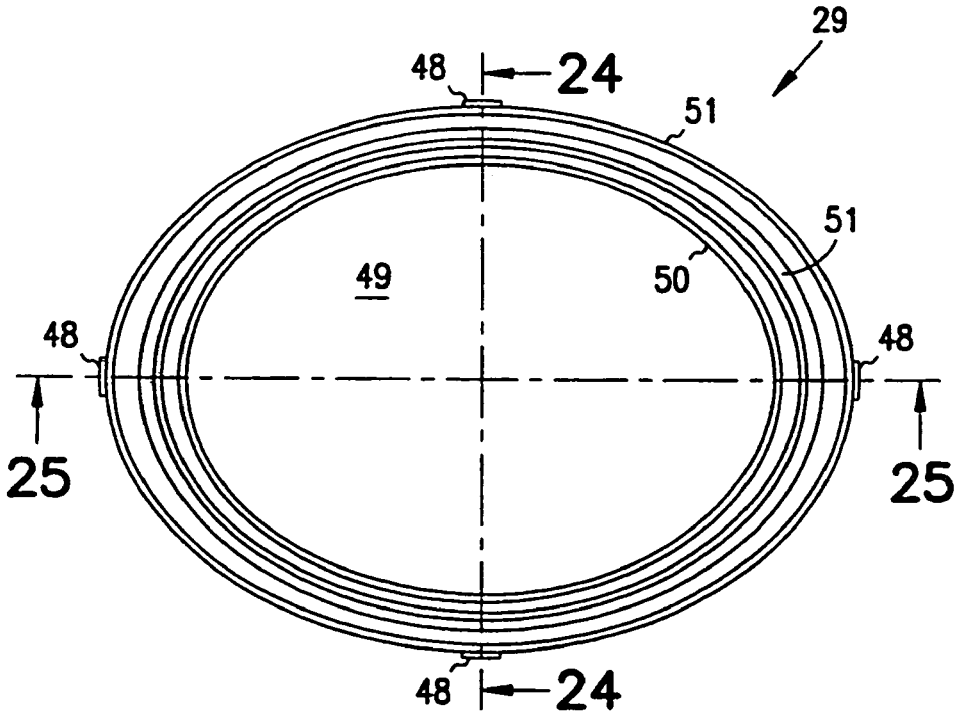
FIG. 26 is a top view of the refill trough of the packaging of FIG. 3.

In FIG. 23 is an execution variant of the packaging according to the present invention, whose trough or well 10 moreover has radially internal chamber 49 for receiving the cosmetic composition, which is delimited by walls 50 and radially external walls 51 for application of cap 13' of cover 6. Cap 13' is applied on the radially internal side of radially external wall 51 and thus ensures temporary hermetic sealing of chamber 29. The radially external force exerted by cap 13' on walls 51 is only very partially transmitted to walls 50, which considerably limits the risk of detachment of the cosmetic composition from wall 50. One preferred embodiment of refill 29, for example, in the form of a trough or well according to the present invention, is illustrated in FIGS. 24 to 26. Trough or well 10 advantageously has an undercut shape, that is to say that its opening 52 has a width smaller than that of its bottom facing it. Consequently, on the one hand, well 10 tends to retain the cosmetic composition if the box according to the present invention is overturned, opening 52 downward, and on the other hand, the narrow walls of the well at the site of opening 52 provide optical masking of the possible detachments of the cosmetic composition with respect to the walls at the bottom due to evaporation of the solvent in case of prolonged opening of the box, corresponding to a common error of users. The undercut shape of trough or well 10 for receiving the cosmetic makes it possible to mask the shrinkage of this composition which is poured hot into the trough or well, during its shrinkage due to a cooling phase.

The undercut well is produced by blowing or advantageously by injection, with a mold which is opened in two steps: first of all, the exterior of the mold is released; then a piston ensures the release of the trough or well with passage of narrow opening 52 through a zone of greater width of the mold by elastic deformation of the plastic material constituting the trough. The attachment of well 10 on lower part 25 of the box according to the present invention is done by any known mechanism such as, for example, by screwing over a quarter turn, pinning, or advantageously, by catching. For example, trough or well 10 has, exterior to walls, radially external wall 51 provided with securing element, for example, in the form of hooks or on the contrary, securing grooves distributed preferably regularly on the periphery of wall 51. In the example illustrated, the well is roughly elliptical, and it has four securing hooks 39 arranged at the intersection of the large and the small axis of the ellipse with the external side of wall 51.

The securing of refill 29 by opening 10 made in base 45 of the box according to the present invention allows one to produce a packaging with a limited space requirement. Moreover, the bottom of well or trough 10 extending advantageously in the extension of the bottom of lower part 25 of the box according to the present invention gives the latter a particularly aesthetic appearance.

Furthermore, well or trough 10 is particularly easy to fill on an automatic filling line, particularly hot. In such a case, the well is made out of a material which is resistant to the filling temperature. The rest of the box can be made of materials with a lower price.

The invention claimed is:

1. A packaging (1) for a cosmetic and/or pharmaceutical composition, comprising a container (3) for receiving a cosmetic and/or pharmaceutical composition (5) and a cover (6), comprising a mechanism of attachment (11) to container (3,) and a sealing wall (15) for sealing an opening (7,) of the container, the sealing wall (15) being elastically deformable by application of a pressure differential, the cover (6,) further comprising an extension having a wall 21 facing the container (3) the extension comprising an annular rib (23) having a thickness in a non-contrained state that is greater than an average distance between the wall (21) of the extension and radial internal wall of container (3) so as to hermetically seal the opening (7) of the packaging.

2. The packaging according to claim 1, wherein the sealing wall (15) comprises a wavy wall with concentric patterns (19) for increasing the flexibility of wall (15) in a direction normal to opening (7, 17) which is to be sealed.

3. The packaging according to claim 1, wherein the container and sealing wall comprise of a box-shape that includes a middle platform (31), a delimiting upper ventilated compartment (33) an internal chamber (7) for receiving cosmetic and/or pharmaceutical composition (5), wherein the platform forms a cover for the internal chamber (7).

4. The packaging according to claim 1, further comprising receiving means for receiving removable container (29) forming a refill of cosmetic and/or pharmaceutical composition (5).

5. The packaging according to claim 4, further comprising a receiving opening and locking means for locking in position, a removable container (29) in a form of a trough or cup, whose opening (17) opens inside the packaging.

6. The packaging of claim 4 wherein the cosmetic and/or pharmaceutical composition comprises one or more of a foundation, cream, rouge or lipstick.

7. The cosmetic and/or pharmaceutical composition of claim 1, further comprising a ventilated compartment (33), with a mechanism of application of cosmetic and/or pharmaceutical composition (5) comprising a sponge.

8. A sealed packaging for cosmetic or pharmaceutical compositions comprising a sealed compartment (12) defined by container (1) and fitted cover (3), comprising radial first and second walls that are arranged a distance d apart from one another; wherein the first wall (9, 15) is provided with annular rib (19) having a radial extent in the direction of the second wall (15, 9) which is greater than d, the rib 19 being elastically deformable by application of a pressure differential, exerting on the second wall (15, 9) a radial force ensuring temporary hermetic sealing of sealed compartment (12) of the packaging.

9. The packaging according to claim 8, further comprising a mechanism of locking (37) the packaging in a closed state in which sealed compartment (12) is hermetically sealed.

10. The packaging according to claim 8 further comprising an annular rib (23) arranged on a radially external side of wall (15) of cover (6) arranged opposite a radially internal side of wall (9) of container (1).

11. The packaging according to claim 8, further comprising a container (1) having two parallel 4 walls (9, 9') and a rib (23).

12. The packaging according to claim 8 further comprising a container (1) having wall (9,9') delimiting space (12) for storage of cosmetic andlor pharmaceutical composition, which has an undercut shape.

13. The packaging according to claim 8 further comprising a cover (6) having wall (21) deformable by a difference in pressure exerted on its two main sides so as to ensure compensation for this difference in pressure.

14. The packaging according to claim 8, further comprising having a shape of a box which has lower part (25, 25') forming or receiving container (3, 40, 40'), separation platform (30') forming a cover for a sealed compartment and upper part (27) forming a cover for the box.

15. The packaging according to claim 8, further comprising a platform (30') that delimits a chamber for receiving means of application of the cosmetic or pharmaceutical composition, which has openings ensuring the ventilation of this chamber.

16. The packaging according to claim 8, further comprising a box which has a receiving opening and means of locking in position, in particular, means (42, 45) of clipping of removable cup (33').

17. A cosmetic or pharmaceutical composition, particularly foundations, creams, rouges, lipsticks, further comprising positioning in packaging according to claim 8.

18. The packaging according to claim 8, further comprising a refillable packaging comprising an external envelope (1), defining an opening (46) for receiving a refill of cosmetic or pharmaceutical composition (5), the refillable packaging further defining an opening (41) that opens inside external envelope (1), and locking means for locking the refill in position.

19. The packaging according to claim 18 wherein locking means comprises projecting elements (50, 51) ensuring the locking.

20. The packaging according to claim 18 further comprising sealing means (11, 41) for hermetic sealing of the refill, the sealing means comprising a rib (23) which is positioned radially on wall facing the rib in order to ensure hermetic sealing.

21. The packaging according to claim 18, wherein said packaging comprises a flat box and the refill comprises a trough or a well.

22. The packaging according to claim 18, further comprising a platform (29) delimiting chamber (17) for receiving cosmetic and/or pharmaceutical composition (5) and a ventilated compartment (33) for receiving means of application of cosmetic and/or pharmaceutical composition (5).

23. The packaging according to claim 18, further comprising a platform (30) which is deformable so as to allow compensation for the difference in pressure between the interior and the exterior of.

24. A cosmetic and/or pharmaceutical composition, characterized in that it is packaged in a packaging according to claim 18.

* * * * *

UNITED STATES PATENT AND TRADEMARK OFFICE

CERTIFICATE OF CORRECTION

PATENT NO. : 7,334,685 B2
APPLICATION NO. : 09/865056
DATED : February 26, 2008
INVENTOR(S) : Mathiez It is certified that error appears in the above-identified patent and that said Letters Patent is hereby corrected as shown below:

In column 12, line 34, in Claim 1, delete "(3,)" and insert -- (3) --, therefor.

In column 12, line 34, in Claim 1, delete "(7,)" and insert -- (7) --, therefor.

In column 12, line 36, in Claim 1, delete "(6,)" and insert -- (6) --, therefor.

In column 12, line 39, in Claim 1, delete "non-contrained" and insert -- non-constrained --, therefor.

In column 12, line 48, in Claim 3, after "comprise" delete "of".

In column 13, line 20, in Claim 11, after "parallel" delete "4".

In column 13, line 23, in Claim 12, delete "(9,9')" and insert -- (9, 9') --, therefor.

In column 13, line 24, in Claim 12, delete "andlor" and insert -- and/or --, therefor.

In column 14, line 34, in Claim 23, after "of" delete "." and insert -- the refill. --, therefor.

Signed and Sealed this

Eighth Day of July, 2008

JON W. DUDAS
*Director of the United States Patent and Trademark Office*